US010930406B2

(12) United States Patent
Pang et al.

(10) Patent No.: US 10,930,406 B2
(45) Date of Patent: Feb. 23, 2021

(54) LIQUID-PHASE OXIDATIVE DIGESTION METHOD FOR RADIOACTIVELY CONTAMINATED CARBON-CONTAINING MATERIAL

(71) Applicant: Institute of Materials, China Academy of Engineering Physics, Sichuan (CN)

(72) Inventors: Min Pang, Sichuan (CN); Peilun Sang, Sichuan (CN); Ning Zeng, Sichuan (CN); Qingkai Zhao, Sichuan (CN); Shun Li, Sichuan (CN)

(73) Assignee: Institute of Materials, China Academy of Engineering Physics, Mianyang (CN)

( * ) Notice: Subject to any disclaimer, the term of this patent is extended or adjusted under 35 U.S.C. 154(b) by 136 days.

(21) Appl. No.: 16/198,905

(22) Filed: Nov. 23, 2018

(65) Prior Publication Data

US 2019/0096537 A1 Mar. 28, 2019

Related U.S. Application Data

(63) Continuation-in-part of application No. PCT/CN2017/082560, filed on Apr. 28, 2017.

(30) Foreign Application Priority Data

May 23, 2016 (CN) ..... 201610339632.X

(51) Int. Cl.
*G21F 9/00* (2006.01)
*G21F 9/32* (2006.01)
*G21F 9/30* (2006.01)

(52) U.S. Cl.
CPC ..... *G21F 9/32* (2013.01); *G21F 9/00* (2013.01); *G21F 9/30* (2013.01)

(58) Field of Classification Search
CPC ..... G21F 9/00; G21F 9/32; G21F 9/30
See application file for complete search history.

(56) References Cited

U.S. PATENT DOCUMENTS

2002/0064251 A1 5/2002 Mason et al.
2011/0020729 A1* 1/2011 Monden ..... H01M 4/88 429/483
2013/0158322 A1* 6/2013 Nyce ..... C07C 11/04 585/330
2014/0121440 A1 5/2014 Laurent
2014/0194666 A1 7/2014 Laurent
2015/0073198 A1 3/2015 Ishida et al.

FOREIGN PATENT DOCUMENTS

| | | | |
|---|---|---|---|
| CN | 1391696 | A | 1/2003 |
| CN | 104137189 | A | 11/2014 |
| CN | 104903968 | A | 9/2015 |
| CN | 105051827 | A | 11/2015 |
| EP | 1228513 | A2 | 8/2002 |
| EP | 2625403 | A1 | 8/2013 |
| EP | 2769384 | A1 | 8/2014 |
| EP | 2912670 | A1 | 9/2015 |
| EP | 2943960 | A1 | 11/2015 |
| FR | 2828576 | A1 | 2/2003 |
| GB | 2381649 | A | 5/2003 |
| JP | 2013542363 | A | 11/2013 |
| KR | 1020150000581 | A | 1/2015 |

OTHER PUBLICATIONS

Notice of Allowance of Counterpart European Patent Application No. 17802024.4 dated Jan. 8, 2020.
Examination Report of Counterpart European Patent Application No. 17802024.4 dated Dec. 5, 2018.
Search Report of Counterpart European Patent Application No. 17802024.4 dated Sep. 18, 2018.

* cited by examiner

*Primary Examiner* — Cynthia H Kelly
*Assistant Examiner* — Monique M Wills

(57) ABSTRACT

Disclosed is a liquid-phase oxidative decomposition method for radioactively contaminated carbonaceous material, providing a method of oxidizing carbon into a gas in liquid phase to treat radioactively contaminated carbonaceous material. The method comprises the following steps: ball milling a mixture of a molybdenum-containing substance and a carbonaceous material, thermally treating the ball milled mixture, and performing liquid-phase oxidation of the thermally treated mixture. The thermal treatment causes carbon to enter space between molybdenum atoms so as to reduce the particle size of carbon and improve the chemical reactivity of carbon, and an oxidant is then used to oxidize the carbon in the space between molybdenum atoms into a gas in liquid phase, while the molybdenum-containing moiety is converted into a water-soluble substance. The method of has technical effects of mild reaction conditions, low energy consumption, high operation safety, and facilitates the recovery of elements attached to carbonaceous material.

13 Claims, No Drawings

LIQUID-PHASE OXIDATIVE DIGESTION METHOD FOR RADIOACTIVELY CONTAMINATED CARBON-CONTAINING MATERIAL

CROSS-REFERENCE TO RELATED APPLICATION

The present disclosure is a continuation-in-part application of the international patent application No. PCT/CN2017/082560 filed on Apr. 28, 2017, which claims priority to Chinese patent application No. 201610339632.X filed on May 23, 2016. The contents of the above applications are hereby incorporated by reference.

TECHNICAL FIELD

The present disclosure relates to the technical field of radioactive waste disposal, in particular to a method of oxidative digestion of a radioactively contaminated carbonaceous material (carbonaceous material) in liquid phase.

BACKGROUND ART

A great amount of radioactively contaminated carbonaceous materials are produced during nuclear-related processes, for example, graphitic layers in nuclear reactors for moderating/reflecting neutrons, graphite crucibles and graphite molds used in smelting, casting and analyzing radioactive materials, resin used in the disposal of radioactive waste liquid and so forth. For the disposal of radioactively contaminated carbon materials, there is no thorough and mature solution so far. Existing incineration technology can barely be used for volume reduction of a carbonaceous material with a low level of radioactive contamination. However, once a carbonaceous material with a relatively high level of radioactive contamination is involved, e.g. graphite crucibles and graphite molds contaminated by uranium, the incineration of such radioactively contaminated carbonaceous materials is infeasible due to the fact that the current incinerator cannot ensure that the uranium aerosol is thoroughly cut off.

Carbon, especially high-purity carbon used in the nuclear industry, is an excellent heat conductor, and this property renders carbon unable to store heat, and if carbon is to be oxidized through incineration, persistent high energy input is required to maintain the temperature of carbon above 1000° C., this process is of high energy consumption and the deterioration of the sealing performance of the device at a high temperature would be accompanied by the risk of radioactive aerosol leakage. Steam reforming utilizes high-temperature steam to oxidize carbon into a gas ($C+H_2O \rightarrow CO+CO+H_2$), which may also be a disposal mode for radioactively contaminated carbonaceous materials. However, the significant oxidation of carbon by water occurs at a temperature above 1000° C., while it is highly likely for matching failure to occur to a connecting piece of the device under such condition due to thermal expansion, hereby resulting in a radioactive aerosol leakage.

Accordingly, as for the volume-reduction and weight-reduction disposal of radioactively contaminated carbonaceous materials, it is necessary to moderate the reaction conditions as much as possible, to inhibit the generation of radioactive aerosol, and to ensure a safe, stable and reliable disposal process.

DISCLOSURE OF THE INVENTION

An object of the present disclosure is to provide a technical solution for a method of oxidative digestion of a radioactively contaminated carbonaceous material in liquid phase, in the light of the deficiencies existing in the prior art, wherein the technical solution utilizes thermal treatment to make carbon enter the space between molybdenum atoms, which reduces the particle size of carbon and enhances the chemical reactivity of carbon. Consequently, carbon in the space between molybdenum atoms is oxidized in liquid phase into a gas by an oxidant, and simultaneously, the molybdenum-containing moiety is converted into a water-soluble substance, hereby achieving effects of mild reaction conditions, low energy consumption, high operational safety and conduciveness to recovery of elements attached to the carbonaceous material.

The present solution is realized through the following technical measures:

A method of oxidative digestion of a radioactively contaminated carbonaceous material in liquid phase, comprising the following steps:

a. milling a mixture of a molybdenum-containing substance and a carbonaceous material by using a planetary ball mill with a fixed ball mill revolution speed, to provide first-stage powders;

b. placing the first-stage powders obtained in Step a) into a heating furnace, thermally treating the first-stage powders under a flowing gas, and then naturally cooling the first-stage powders to provide second-stage powders; and c. adding the second-stage powders to water, and adding an oxidant, such that carbon contained therein is oxidized into a gas, and the molybdenum-containing moiety is converted into a water-soluble substance.

Preferably in the present solution: the component ratio between the carbonaceous material and the molybdenum-containing substance in Step a) is, in parts by weight, 1 part of the carbonaceous material to 2-50 parts of the molybdenum-containing substance.

Preferably in the present solution: the component ratio between the carbonaceous material and the molybdenum-containing substance in Step a) is, in parts by weight, 1 part of the carbonaceous material to 3.5-50 parts of the molybdenum-containing substance.

Preferably in the present solution: the component ratio between the carbonaceous material and the molybdenum-containing substance in Step a) is, in parts by weight, 1 part of the carbonaceous material to 2 parts, 3 parts, 3.5 parts, 10 parts, 15 parts, 20 parts, 30 parts, 40 parts or 50 parts of the molybdenum-containing substance.

Preferably in the present solution: the gas in Step b) is an inert gas or a gas mixture of hydrogen and an inert gas.

Preferably in the present solution: the oxidant in Step c) is one from ozone, hydrogen peroxide, permanganates, dichromates, or a free combination thereof.

Preferably in the present solution: the molybdenum-containing substance is one from molybdenum trioxide, molybdenum dioxide, hexaammonium molybdate, phosphomolybdic acid, silicomolybdic acid, and metallic molybdenum, or a free combination thereof.

Preferably in the present solution: the carbonaceous material is activated carbon or carbon nanotubes or graphite or carbon fibers or carbon black or resin.

Preferably in the present solution: the inert gas is argon, helium or nitrogen.

Preferably in the present solution: the thermal treatment in Step b) is realized at a temperature rise rate of 0.5-20° C./min, till a temperature of 500-1100° C., with the temperature being maintained for 1-6 hours.

Preferably in the present solution: the thermal treatment in Step b) is realized at a temperature rise rate of 0.5-20°

C./min, till a temperature of 900-1100° C., with the temperature being maintained for 1-6 hours.

Preferably in the present solution: the thermal treatment in Step b) is realized at a temperature rise rate of 0.5° C./min, 1° C./min, 2° C./min, 5° C./min, 10° C./min or 20° C./min.

Preferably in the present solution: the heating in Step b) is performed till a temperature of 500° C., 600° C., 700° C., 750° C., 800° C., 900° C., 1000° C. or 1100° C.

Preferably in the present solution: the duration of temperature maintenance of the high temperature condition during the thermal treatment in Step b) is 1 hour, 2 hours, 4 hours, 5 hours or 6 hours.

The beneficial effects of the present solution can be determined from the preceding statement of the solution, the technical solution utilizes thermal treatment to make carbon enter the space between molybdenum atoms, which reduces the particle size of carbon and enhances the chemical reactivity of carbon. Consequently, carbon in the space between molybdenum atoms can be oxidized in liquid phase into a gas by an oxidant, and simultaneously, the molybdenum-containing moiety is converted into a water-soluble substance, hereby achieving effects of mild reaction conditions, low energy consumption, high operational safety and conduciveness to recovery of elements attached to the carbonaceous material.

Accordingly, compared with the prior art, the present disclosure has a substantive feature and represents a progress, and the beneficial effects of its implementation are also apparent.

DETAILED DESCRIPTION OF THE EMBODIMENTS

Except for mutually exclusive features and/or steps, all the features or all the steps in the method or the process disclosed in the present specification may be combined with each other in any manner.

Unless expressly stated otherwise, any feature disclosed in the specification (including any appended claims, the abstract or the drawings) can be replaced by any other alternative feature that is equivalent or has a similar object. That is to say, unless expressly stated otherwise, each feature is only one example of a series of equivalent or similar features.

A method of oxidative digestion of a radioactively contaminated carbonaceous material in liquid phase, comprising the following steps:

(1) milling a mixture of a molybdenum-containing substance and a carbonaceous material by using a planetary ball mill at a fixed ball mill revolution speed, to provide first-stage powders;

(2) placing the first-stage powders obtained in Step (1) into a heating furnace, performing thermal treatment to the first-stage powders under a flowing gas, and then naturally cooling the same to provide second-stage powders;

(3) adding the second-stage powders to water, and adding an oxidant, such that carbon contained therein is oxidized into a gas, and molybdenum-containing moiety is converted into a water-soluble substance.

Example 1

(1) Graphite and molybdenum trioxide were mixed in a weight ratio of 1:20, and then placed in a ball mill pot and milled for 3 hours by using a planetary ball mill at a revolution speed of 300 r/min;

(2) 2 g of the obtained powders was placed in a tube furnace and heated to 900° C. at a temperature rise rate of 2° C./min in an argon-hydrogen mixture with the argon having a flowing rate of 30 ml/min and the hydrogen having a flowing rate of 50 ml/min, wherein the temperature was maintained for 4 hours, then the gas was turned off, and powders were obtained after natural cooling; and (3) 1 g of the obtained powders was added to 20 ml of 30 wt % hydrogen peroxide, and the digestion rate of the graphite was determined as 100% after 1 hour.

Example 2

(1) Graphite and molybdenum trioxide were mixed in a weight ratio of 1:20, and then placed in a ball mill pot and milled for 3 hours by using a planetary ball mill at a revolution speed of 300 r/min;

(2) 2 g of the obtained powders was placed in a tube furnace and heated to 900° C. at a temperature rise rate of 2° C./min in an argon-hydrogen mixture with the argon having a flowing rate of 30 ml/min and the hydrogen having a flowing rate of 50 ml/min, wherein the temperature was maintained for 4 hours, then the gas was turned off, and powders were obtained after natural cooling; and (3) 1 g of the obtained powders was added to 20 ml of 30 wt % hydrogen peroxide, and the digestion rate of the graphite was determined as 100% after 1 hour.

Example 3

(1) Activated carbon and molybdenum trioxide were mixed in a weight ratio of 1:15, and then placed in a ball mill pot and milled for 3 hours by using a planetary ball mill at a revolution speed of 300 r/min;

(2) 2 g of the obtained powders was placed in a tube furnace and heated to 700° C. at a temperature rise rate of 5° C./min in a helium-hydrogen mixture with the helium having a flowing rate of 30 ml/min and the hydrogen having a flowing rate of 50 ml/min, wherein the temperature was maintained for 2 hours, then the gas was turned off, and powders were obtained after natural cooling; and (3) 1 g of the obtained powders was added to 20 ml of 30 wt % potassium permanganate water solution, and the digestion rate of the activated carbon was determined as 60% after 1 hour.

Example 4

(1) Graphite and molybdenum trioxide were mixed in a weight ratio of 1:10, and then placed in a ball mill pot and milled for 3 hours by using a planetary ball mill at a revolution speed of 300 r/min;

(2) 2 g of the obtained powders was placed in a tube furnace and heated to 900° C. at a temperature rise rate of 2° C./min in an argon-hydrogen mixture with the argon having a flowing rate of 30 ml/min and the hydrogen having a flowing rate of 50 ml/min, wherein the temperature was maintained for 4 hours, then the gas was turned off, and powders were obtained after natural cooling; and (3) 1 g of the obtained powders was added to 20 ml of 30 wt % hydrogen peroxide, and the digestion rate of the graphite was determined as 100% after 1 hour.

Example 5

(1) Graphite and hexaammonium molybdate were mixed in a weight ratio of 1:40, and then placed in a ball mill pot and milled for 3 hours by using a planetary ball mill at a revolution speed of 300 r/min;

(2) 2 g of the obtained powders was placed in a tube furnace and heated to 900° C. at a temperature rise rate of 2° C./min in an argon-hydrogen mixture with the argon having a flowing rate of 30 ml/min and the hydrogen having a flowing rate of 50 ml/min, wherein the temperature was maintained for 4 hours, then the gas was turned off, and powders were obtained after natural cooling; and (3) 1 g of the obtained powders was added to 20 ml of 30 wt % hydrogen peroxide, and the digestion rate of the graphite was determined as 100% after 1 hour.

Example 6

(1) Graphite and molybdenum trioxide were mixed in a weight ratio of 1:30, and then placed in a ball mill pot and milled for 3 hours by using a planetary ball mill at a revolution speed of 300 r/min;

(2) 2 g of the obtained powders was placed in a tube furnace and heated to 600° C. at a temperature rise rate of 2° C./min in an argon-hydrogen mixture with the argon having a flowing rate of 30 ml/min and the hydrogen having a flowing rate of 50 ml/min, wherein the temperature was maintained for 5 hours, then the gas was turned off, and powders were obtained after natural cooling; and (3) 1 g of the obtained powders was added to 20 ml of 30 wt % hydrogen peroxide, and the digestion rate of the graphite was determined as 48% after 1 hour.

Example 7

(1) Graphite and phosphomolybdic acid were mixed in a weight ratio of 1:30, and then placed in a ball mill pot and milled for 3 hours by using a planetary ball mill at a revolution speed of 300 r/min;

(2) 2 g of the obtained powders was placed in a tube furnace and heated to 900° C. at a temperature rise rate of 2° C./min in an argon-hydrogen mixture with the argon having a flowing rate of 30 ml/min and the hydrogen having a flowing rate of 50 ml/min, wherein the temperature was maintained for 4 hours, then the gas was turned off, and powders were obtained after natural cooling; and (3) 1 g of the obtained powders was added to 20 ml of 30 wt % hydrogen peroxide, and the digestion rate of the graphite was determined as 100% after 1 hour.

Example 8

(1) Graphite and molybdenum dioxide were mixed in a weight ratio of 1:20, and then placed in a ball mill pot and milled for 3 hours by using a planetary ball mill at a revolution speed of 300 r/min;

(2) 2 g of the obtained powders was placed in a tube furnace and heated to 900° C. at a temperature rise rate of 2° C./min in an argon-hydrogen mixture with the argon having a flowing rate of 30 ml/min and the hydrogen having a flowing rate of 50 ml/min, wherein the temperature was maintained for 5 hours, then the gas was turned off, and powders were obtained after natural cooling; and (3) 1 g of the obtained powders was added to 20 ml of 30 wt % hydrogen peroxide, and the digestion rate of the graphite was determined as 100% after 1 hour.

Example 9

(1) Graphite and silicomolybdic acid were mixed in a weight ratio of 1:50, and then placed in a ball mill pot and milled for 3 hours by using a planetary ball mill at a revolution speed of 300 r/min;

(2) 2 g of the obtained powders was placed in a tube furnace and heated to 900° C. at a temperature rise rate of 20° C./min in an argon-hydrogen mixture with the argon having a flowing rate of 30 ml/min and the hydrogen having a flowing rate of 50 ml/min, wherein the temperature was maintained for 1 hour, then the gas was turned off, and powders were obtained after natural cooling; and (3) 1 g of the obtained powders was added to 20 ml of 30 wt % hydrogen peroxide, and the digestion rate of the graphite was determined as 100% after 1 hour.

Example 10

(1) Graphite and molybdenum trioxide were mixed in a weight ratio of 1:5, and then placed in a ball mill pot and milled for 1 hour by using a planetary ball mill at a revolution speed of 300 r/min;

(2) 2 g of the obtained powders was placed in a tube furnace and heated to 500° C. at a temperature rise rate of 1° C./min in an argon-hydrogen mixture with the argon having a flowing rate of 30 ml/min and the hydrogen having a flowing rate of 50 ml/min, wherein the temperature was maintained for 5 hours, then the gas was turned off, and powders were obtained after natural cooling; and (3) 1 g of the obtained powders was added to 20 ml of 30 wt % hydrogen peroxide, and the digestion rate of the graphite was determined as 22% after 1 hour.

Example 11

(1) D152 macroporous weak acid cation exchange resin and molybdenum trioxide were mixed in a weight ratio of 1:30, and then placed in a ball mill pot and milled for 3 hours by using a planetary ball mill at a revolution speed of 300 r/min;

(2) 2 g of the obtained powders was placed in a tube furnace and heated to 1000° C. at a temperature rise rate of 2° C./min in a helium-hydrogen mixture with the helium having a flowing rate of 30 ml/min and the hydrogen having a flowing rate of 50 ml/min, wherein the temperature was maintained for 5 hours, then the gas was turned off, and powders were obtained after natural cooling; and (3) 1 g of the obtained powders was added to 20 ml of 30 wt % hydrogen peroxide, and the digestion rate of the D152 macroporous weak acid cation exchange resin was determined as 100% after 1 hour.

Example 12

(1) 717-type strong base anion exchange resin and molybdenum trioxide were mixed in a weight ratio of 1:30, and then placed in a ball mill pot and milled for 3 hours by using a planetary ball mill at a revolution speed of 300 r/min;

(2) 2 g of the obtained powders was placed in a tube furnace and heated to 1000° C. at a temperature rise rate of 2° C./min in a helium-hydrogen mixture with the helium having a flowing rate of 30 ml/min and the hydrogen having a flowing rate of 50 ml/min, wherein the temperature was maintained for 5 hours, then the gas was turned off, and powders were obtained after natural cooling; and (3) 1 g of the obtained powders was added to 20 ml of 30 wt % hydrogen peroxide, and the digestion rate of the 717-type strong base anion exchange resin was determined as 100% after 1 hour.

Example 13

(1) Graphite and phosphomolybdic acid were mixed in a weight ratio of 1:40, and then placed in a ball mill pot and milled for 3 hours by using a planetary ball mill at a revolution speed of 300 r/min;

(2) 2 g of the obtained powders was placed in a tube furnace and heated to 900° C. at a temperature rise rate of 0.5° C./min in a helium-hydrogen mixture with the helium having a flowing rate of 30 ml/min and the hydrogen having a flowing rate of 50 ml/min, wherein the temperature was maintained for 4 hours, then the gas was turned off, and powders were obtained after natural cooling; and (3) 1 g of the obtained powders was added to 20 ml of 30 wt % hydrogen peroxide, and the digestion rate of the graphite was determined as 100% after 1 hour.

Example 14

(1) Natural flake graphite and metallic molybdenum were mixed in a weight ratio of 1:20, and then placed in a ball mill pot and milled for 3 hours by using a planetary ball mill at a revolution speed of 300 r/min;

(2) 2 g of the obtained powders was placed in a tube furnace and heated to 1100° C. at a temperature rise rate of 1° C./min in a helium-hydrogen mixture with the helium having a flowing rate of 30 ml/min and the hydrogen having a flowing rate of 50 ml/min, wherein the temperature was maintained for 5 hours, then the gas was turned off, and powders were obtained after natural cooling; and (3) 1 g of the obtained powders was added to 20 ml of 30 wt % hydrogen peroxide, and the digestion rate of the graphite was determined as 100% after 1 hour.

Example 15

(1) Graphite and molybdenum trioxide were mixed in a weight ratio of 1:5, and then placed in a ball mill pot and milled for 3 hours by using a planetary ball mill at a revolution speed of 300 r/min;

(2) 2 g of the obtained powders was placed in a tube furnace and heated to 900° C. at a temperature rise rate of 2° C./min in argon with a flowing rate of 100 ml/min, wherein the temperature was maintained for 6 hours, then the gas was turned off, and powders were obtained after natural cooling; and (3) 1 g of the obtained powders was added to 200 ml of water acidized by nitric acid, and after blowing ozone therein at a velocity of 10 g/h for 5 hours, the digestion rate of the graphite was determined as 98%.

Example 16

(1) Graphite and molybdenum trioxide were mixed in a weight ratio of 1:4, and then placed in a ball mill pot and milled for 3 hours by using a planetary ball mill at a revolution speed of 300 r/min;

(2) 2 g of the obtained powders was placed in a tube furnace and heated to 900° C. at a temperature rise rate of 2° C./min in an argon-hydrogen mixture with the argon having a flowing rate of 5 ml/min and the hydrogen having a flowing rate of 95 ml/min, wherein the temperature was maintained for 6 hours, then the gas was turned off, and powders were obtained after natural cooling; and (3) 1 g of the obtained powders was added to 20 ml of 30 wt % hydrogen peroxide, and the digestion rate of the graphite was determined as 100% after 0.5 hour.

Example 17

(1) Activated carbon and molybdenum trioxide were mixed in a weight ratio of 1:10, and then placed in a ball mill pot and milled for 3 hours by using a planetary ball mill at a revolution speed of 300 r/min;

(2) 2 g of the obtained powders was placed in a tube furnace and heated to 700° C. at a temperature rise rate of 5° C./min in a helium-hydrogen mixture with the helium having a flowing rate of 30 ml/min and the hydrogen having a flowing rate of 50 ml/min, wherein the temperature was maintained for 4 hours, then the gas was turned off, and powders were obtained after natural cooling; and (3) 1 g of the obtained powders was added to 100 ml of 30 wt % potassium permanganate water solution, and the digestion rate of the activated carbon was determined as 40% after 1 hour.

Example 18

(1) D152 macroporous weak acid cation exchange resin and molybdenum trioxide were mixed in a weight ratio of 1:6, and then placed in a ball mill pot and milled for 3 hours by using a planetary ball mill at a revolution speed of 300 r/min;

(2) 2 g of the obtained powders was placed in a tube furnace and heated to 1100° C. at a temperature rise rate of 0.5° C./min in argon with a flowing rate of 100 ml/min, wherein the temperature was maintained for 6 hours, then the gas was turned off, and powders were obtained after natural cooling; and (3) 1 g of the obtained powders was added to 200 ml of water alkalized by sodium hydroxide, and after blowing ozone therein at a velocity of 10 g/h for 5 hours, the digestion rate of the resin was determined as 98%.

Example 19

(1) Graphite and hexaammonium molybdate were mixed in a weight ratio of 1:50, and then placed in a ball mill pot and milled for 3 hours by using a planetary ball mill at a revolution speed of 300 r/min;

(2) 2 g of the obtained powders was placed in a tube furnace and heated to 1000° C. at a temperature rise rate of 5° C./min in argon with a flowing rate of 100 ml/min, wherein the temperature was maintained for 6 hours, then the gas was turned off, and powders were obtained after natural cooling; and (3) 1 g of the obtained powders was added to 20 ml of 30 wt % hydrogen peroxide, and the digestion rate of the graphite was determined as 96% after 1 hour.

Example 20

(1) Graphite and molybdenum trioxide were mixed in a weight ratio of 1:2, and then placed in a ball mill pot and milled for 3 hours by using a planetary ball mill at a revolution speed of 300 r/min;

(2) 2 g of the obtained powders was placed in a tube furnace and heated to 900° C. at a temperature rise rate of 20° C./min in an argon-hydrogen mixture with the argon having a flowing rate of 30 ml/min and the hydrogen having a flowing rate of 50 ml/min, wherein the temperature was maintained for 1 hour, then the gas was turned off, and powders were obtained after natural cooling; and (3) 1 g of the obtained powders was added to 20 ml of 30 wt % hydrogen peroxide, and the digestion rate of the graphite was determined as 62% after 1 hour.

Example 21

(1) Graphite and phosphomolybdic acid were mixed in a weight ratio of 1:30, and then placed in a ball mill pot and milled for 3 hours by using a planetary ball mill at a revolution speed of 300 r/min;

(2) 2 g of the obtained powders was placed in a tube furnace and heated to 900° C. at a temperature rise rate of 5° C./min in a nitrogen-hydrogen mixture with the nitrogen having a flowing rate of 5 ml/min and the hydrogen having a flowing rate of 95 ml/min, wherein the temperature was maintained for 6 hours, then the gas was turned off, and powders were obtained after natural cooling; and (3) 1 g of the obtained powders was added to 20 ml of 30 wt % hydrogen peroxide, and the digestion rate of the graphite was determined as 90% after 1 hour.

Example 22

(1) Graphite and molybdenum dioxide were mixed in a weight ratio of 1:10, and then placed in a ball mill pot and milled for 3 hours by using a planetary ball mill at a revolution speed of 300 r/min;

(2) 2 g of the obtained powders was placed in a tube furnace and heated to 900° C. at a temperature rise rate of 2° C./min in nitrogen with a flowing rate of 100 ml/min, wherein the temperature was maintained for 5 hours, then the gas was turned off, and powders were obtained after natural cooling; and (3) 1 g of the obtained powders was added to 200 ml of water acidized by nitric acid, and after blowing ozone therein at a velocity of 10 g/h for 5 hours, the digestion rate of the graphite was determined as 85%.

Example 23

(1) Graphite and silicomolybdic acid were mixed in a weight ratio of 1:50, and then placed in a ball mill pot and milled for 3 hours by using a planetary ball mill at a revolution speed of 300 r/min;

(2) 2 g of the obtained powders was placed in a tube furnace and heated to 700° C. at a temperature rise rate of 20° C./min in an argon-hydrogen mixture with the argon having a flowing rate of 30 ml/min and the hydrogen having a flowing rate of 50 ml/min, wherein the temperature was maintained for 4 hours, then the gas was turned off, and powders were obtained after natural cooling; and (3) 1 g of the obtained powders was added to 20 ml of 30 wt % hydrogen peroxide, and the digestion rate of the graphite was determined as 39% after 1 hour.

Example 24

(1) 717-type strong base anion exchange resin and molybdenum trioxide were mixed in a weight ratio of 1:10, and then placed in a ball mill pot and milled for 3 hours by using a planetary ball mill at a revolution speed of 300 r/min;

(2) 2 g of the obtained powders was placed in a tube furnace and heated to 900° C. at a temperature rise rate of 2° C./min in a helium-hydrogen mixture with the helium having a flowing rate of 5 ml/min and the hydrogen having a flowing rate of 95 ml/min, wherein the temperature was maintained for 6 hours, then the gas was turned off, and powders were obtained after natural cooling; and (3) 1 g of the obtained powders was added to 20 ml of 30 wt % hydrogen peroxide, and the digestion rate of the 717-type strong base anion exchange resin was determined as 100% after 1 hour.

Example 25

(1) Natural flake graphite and metallic molybdenum were mixed in a weight ratio of 1:50, and then placed in a ball mill pot and milled for 3 hours by using a planetary ball mill at a revolution speed of 300 r/min;

(2) 2 g of the obtained powders was placed in a tube furnace and heated to 900° C. at a temperature rise rate of 1° C./min in helium with a flowing rate of 100 ml/min, wherein the temperature was maintained for 6 hours, then the gas was turned off, and powders were obtained after natural cooling; and (3) 1 g of the obtained powders was added to 20 ml of 30 wt % hydrogen peroxide, and the digestion rate of the graphite was determined as 78% after 1 hour.

Example 26

(1) Graphite and molybdenum trioxide were mixed in a weight ratio of 1:3.5, and then placed in a ball mill pot and milled for 3 hours by using a planetary ball mill at a revolution speed of 300 r/min;

(2) 2 g of the obtained powders was placed in a tube furnace and heated to 900° C. at a temperature rise rate of 20° C./min in an argon-hydrogen mixture with the argon having a flowing rate of 30 ml/min and the hydrogen having a flowing rate of 50 ml/min, wherein the temperature was maintained for 1 hour, then the gas was turned off, and powders were obtained after natural cooling; and (3) 1 g of the obtained powders was added to 20 ml of 30 wt % hydrogen peroxide, and the digestion rate of the graphite was determined as 100% after 1 hour.

Example 27

(1) Graphite and silicomolybdic acid were mixed in a weight ratio of 1:50, and then placed in a ball mill pot and milled for 3 hours by using a planetary ball mill at a revolution speed of 300 r/min;

(2) 2 g of the obtained powders was placed in a tube furnace and heated to 900° C. at a temperature rise rate of 20° C./min in an argon-hydrogen mixture with the argon having a flowing rate of 30 ml/min and the hydrogen having a flowing rate of 50 ml/min, wherein the temperature was maintained for 4 hours, then the gas was turned off, and powders were obtained after natural cooling; and (3) 1 g of the obtained powders was added to 20 ml of 30 wt % hydrogen peroxide, and the digestion rate of the graphite was determined as 100% after 1 hour.

Comparative Example 1

(1) Graphite and molybdenum trioxide were mixed in a weight ratio of 1:1.5, and then placed in a ball mill pot and milled for 3 hours by using a planetary ball mill at a revolution speed of 300 r/min;

(2) 2 g of the obtained powders was placed in a tube furnace and heated to 600° C. at a temperature rise rate of 2° C./min in an argon-hydrogen mixture with the argon having a flowing rate of 30 ml/min and the hydrogen having a flowing rate of 50 ml/min, wherein the temperature was maintained for 5 hours, then the gas was turned off, and powders were obtained after natural cooling; and (3) 1 g of the obtained powders was added to 20 ml of 30 wt % hydrogen peroxide, and the digestion rate of the graphite was determined as 11% after 1 hour.

Comparative Example 2

(1) Graphite and molybdenum trioxide were mixed in a weight ratio of 1:10, and then placed in a ball mill pot and milled for 3 hours by using a planetary ball mill at a revolution speed of 300 r/min;

(2) 2 g of the obtained powders was placed in a tube furnace and heated to 400° C. at a temperature rise rate of 2° C./min in an argon-hydrogen mixture with the argon having a flowing rate of 30 ml/min and the hydrogen having a flowing rate of 50 ml/min, wherein the temperature was maintained for 4 hours, then the gas was turned off, and powders were obtained after natural cooling; and (3) 1 g of the obtained powders was added to 20 ml of 30 wt % hydrogen peroxide, and the digestion rate of the graphite was determined as 5% after 1 hour.

Comparative Example 3

(1) Graphite and molybdenum trioxide were mixed in a weight ratio of 1:10, and then placed in a ball mill pot and milled for 3 hours by using a planetary ball mill at a revolution speed of 300 r/min;

(2) 2 g of the obtained powders was placed in a tube furnace and heated to 600° C. at a temperature rise rate of 2° C./min in an argon-hydrogen mixture with the argon having a flowing rate of 30 ml/min and the hydrogen having a flowing rate of 50 ml/min, wherein the temperature was maintained for 30 minutes, then the gas was turned off, and powders were obtained after natural cooling; and (3) 1 g of the obtained powders was added to 20 ml of 30 wt % hydrogen peroxide, and the digestion rate of the graphite was determined as 18% after 1 hour.

Comparative Example 4

(1) Graphite and molybdenum trioxide were mixed in a weight ratio of 1:10, and then placed in a ball mill pot and milled for 3 hours by using a planetary ball mill at a revolution speed of 300 r/min;

(2) 2 g of the obtained powders was placed in a tube furnace and heated to 600° C. at a temperature rise rate of 25° C./min in an argon-hydrogen mixture with the argon having a flowing rate of 30 ml/min and the hydrogen having a flowing rate of 50 ml/min, wherein the temperature was maintained for 4 hours, then the gas was turned off, and powders were obtained after natural cooling; and (3) 1 g of the obtained powders was added to 200 ml of water alkalized by sodium hydroxide, and after blowing ozone therein at a velocity of 10 g/h for 5 hours, the digestion rate of the graphite was determined as 16%.

Comparative Example 5

(1) Graphite and palladium oxide were mixed in a weight ratio of 1:1, and then placed in a ball mill pot and milled for 5 hours by using a planetary ball mill at a revolution speed of 300 r/min;

(2) 2 g of the obtained powders was placed in a tube furnace and heated to 600° C. at a temperature rise rate of 2° C./min in an argon-hydrogen mixture with the argon having a flowing rate of 30 ml/min and the hydrogen having a flowing rate of 50 ml/min, wherein the temperature was maintained for 5 hours, then the gas was turned off, and powders were obtained after natural cooling; and (3) 1 g of the obtained powders was added to 20 ml of 30 wt % hydrogen peroxide, and the loss rate of the graphite was determined after 1 hour as 53%.

Comparative Example 6

(1) Graphite and molybdenum trioxide were mixed in a weight ratio of 1:1, and then placed in a ball mill pot and milled for 3 hours by using a planetary ball mill at a revolution speed of 300 r/min;

(2) 2 g of the obtained powders was placed in a tube furnace and heated to 500° C. at a temperature rise rate of 2° C./min in argon with a flowing rate of 100 ml/min, wherein the temperature was maintained for 6 hours, then the gas was turned off, and powders were obtained after natural cooling; and (3) 1 g of the obtained powders was added to 200 ml of water acidized by nitric acid, and after blowing ozone therein at a velocity of 10 g/h for 5 hours, the digestion rate of the graphite was determined as 10%.

Comparative Example 7

(1) Graphite and molybdenum trioxide were mixed in a weight ratio of 1:10, and then placed in a ball mill pot and milled for 3 hours by using a planetary ball mill at a revolution speed of 300 r/min;

(2) 2 g of the obtained powders was placed in a tube furnace and heated to 400° C. at a temperature rise rate of 2° C./min in argon with a flowing rate of 100 ml/min, wherein the temperature was maintained for 4 hours, then the gas was turned off, and powders were obtained after natural cooling; and (3) 1 g of the obtained powders was added to 20 ml of 30 wt % hydrogen peroxide, and the digestion rate of the graphite was determined as 8% after 1 hour.

Compared with the above comparative examples conducted under non-preferred conditions, it can be determined that the digestion rate of carbon materials is significantly improved and the treatment efficiency is significantly increased, when the amount of a molybdenum oxide group-containing substances, the ball mill revolution speed of the planetary ball mill, the milling duration of the planetary ball mill, the temperature maintained under the high temperature condition during the thermal treatment and the duration of temperature maintenance under the high temperature condition during the thermal treatment fall within the preferred condition ranges according to the present disclosure, hereby achieving the technical effects of mild reaction conditions, low energy consumption, high operational safety and conduciveness to recovery of elements attached to the carbonaceous material.

The present disclosure is not limited to the foregoing detailed description of the embodiments. The present disclosure extends to any novel feature disclosed in this specification or any novel combination thereof, as well as any step in a novel method or process disclosed or any novel combination thereof.

INDUSTRIAL APPLICABILITY

The present disclosure discloses a method of oxidative digestion of a radioactively contaminated carbonaceous material in liquid phase, wherein the method achieves mild reaction conditions, low energy consumption, and high operational safety, and significantly improves the efficiency of the digestive disposal of a carbonaceous material, which is conducive to recovery of elements attached to the carbonaceous material.

The invention claimed is:

1. A method of oxidative digestion of a radioactively contaminated carbonaceous material in liquid phase, comprising steps of:

a) milling a mixture of a molybdenum-containing substance and the radioactively contaminated the radioactively contaminated carbonaceous material by using a planetary ball mill at a fixed ball mill revolution speed to provide first-stage powders;

b) placing the first-stage powders obtained in Step a) into a heating furnace, performing a thermal treatment to the first-stage powders under a flowing gas, and then naturally cooling the first-stage powders to provide second-stage powders; and c) adding the second-stage powders to water, and adding an oxidant, such that such that carbon contained therein is oxidized into a gas, and molybdenum-containing moiety is converted into a water-soluble substance, wherein a component ratio between the radioactively contaminated carbonaceous material and the molybdenum-containing substance in Step a) is, in parts by weight, 1 part of the radioactively contaminated carbonaceous material to 2-50 parts of the molybdenum-containing substance.

2. The method of oxidative digestion of a radioactively contaminated carbonaceous material in liquid phase according to claim 1, wherein a component ratio between the radioactively contaminated carbonaceous material and the molybdenum-containing substance in Step a) is, in parts by weight, 1 part of the radioactively contaminated carbonaceous material to 3.5-50 parts of the molybdenum-containing substance.

3. The method of oxidative digestion of a radioactively contaminated carbonaceous material in liquid phase according to claim 1, wherein a component ratio between the radioactively contaminated carbonaceous material and the molybdenum-containing substance in Step a) is, in parts by weight, 1 part of the radioactively contaminated carbonaceous material to 2 parts, 3 parts, 3.5 parts, 10 parts, 15 parts, 20 parts, 30 parts, 40 parts or 50 parts of the molybdenum-containing substance.

4. The method of oxidative digestion of a radioactively contaminated carbonaceous material in liquid phase according to claim 1, wherein the gas in Step b) is an inert gas or a gas mixture of hydrogen and an inert gas.

5. The method of oxidative digestion of a radioactively contaminated carbonaceous material in liquid phase according to claim 1, wherein the oxidant in Step c) is one of ozone, hydrogen peroxide, permanganates, and dichromates, or any combination thereof.

6. The method of oxidative digestion of a radioactively contaminated carbonaceous material in liquid phase according to claim 1, wherein the molybdenum-containing substance is one of molybdenum trioxide, molybdenum dioxide, hexaammonium molybdate, phosphomolybdic acid, silicomolybdic acid, and metallic molybdenum, or any combination thereof.

7. The method of oxidative digestion of a radioactively contaminated carbonaceous material in liquid phase according to claim 1, wherein the radioactively contaminated carbonaceous material is radioactively contaminated activated carbon, or radioactively contaminated carbon nanotubes, or radioactively contaminated graphite, or radioactively contaminated carbon fibers, or radioactively contaminated carbon black, or radioactively contaminated resin.

8. The method of oxidative digestion of a radioactively contaminated carbonaceous material in liquid phase according to claim 1, wherein the inert gas is argon or helium.

9. The method of oxidative digestion of a radioactively contaminated carbonaceous material in liquid phase according to claim 1, wherein the thermal treatment in Step b) is to heat at a temperature rise rate of 0.5-20° C./min to a temperature of 500-1100° C., with the temperature being maintained for 1-6 hours.

10. The method of oxidative digestion of a radioactively contaminated carbonaceous material in liquid phase according to claim 1, wherein the thermal treatment in Step b) is to heat at a temperature rise rate of 0.5-20° C./min to a temperature of 900-1100° C., with the temperature being maintained for 1-6 hours.

11. The method of oxidative digestion of a radioactively contaminated carbonaceous material in liquid phase according to claim 1, wherein the thermal treatment in Step b) is to heat at a temperature rise rate of 0.5° C./min, 1° C./min, 2° C./min, 5° C./min, 10° C./min or 20° C./min.

12. The method of oxidative digestion of a radioactively contaminated carbonaceous material in liquid phase according to claim 1, wherein the thermal treatment in Step b) is to heat to a temperature of 500° C., 600° C., 700° C., 750° C., 800° C., 900° C., 1000° C. or 1100° C.

13. The method of oxidative digestion of a radioactively contaminated carbonaceous material in liquid phase according to claim 1, wherein a duration for temperature maintenance of a high temperature condition in the thermal treatment in Step b) is 1 hour, 2 hours, 4 hours, 5 hours or 6 hours.

* * * * *